US010132526B2

(12) United States Patent
Ogata et al.

(10) Patent No.: US 10,132,526 B2
(45) Date of Patent: Nov. 20, 2018

(54) EJECTOR REFRIGERATION CYCLE

(71) Applicant: DENSO CORPORATION, Kariya, Aichi-pref. (JP)

(72) Inventors: Gouta Ogata, Kariya (JP); Yuichi Shirota, Kariya (JP); Hiroya Hasegawa, Kariya (JP); Tatsuhiro Suzuki, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 61 days.

(21) Appl. No.: 15/304,667

(22) PCT Filed: May 18, 2015

(86) PCT No.: PCT/JP2015/002488
§ 371 (c)(1),
(2) Date: Oct. 17, 2016

(87) PCT Pub. No.: WO2015/182057
PCT Pub. Date: Dec. 3, 2015

(65) Prior Publication Data

US 2017/0045269 A1 Feb. 16, 2017

(30) Foreign Application Priority Data

May 30, 2014 (JP) ..... 2014-112156

(51) Int. Cl.
*F25B 1/06* (2006.01)
*F25B 1/00* (2006.01)
(Continued)

(52) U.S. Cl.
CPC ..... *F25B 1/06* (2013.01); *F25B 1/00* (2013.01); *F25B 5/02* (2013.01); *F25B 41/067* (2013.01); *F25B 2341/0011* (2013.01)

(58) Field of Classification Search
CPC .... F25B 2341/0012; F25B 41/00; F25B 1/10; F25B 13/00; F25B 1/06; F25B 1/00;
(Continued)

(56) References Cited

U.S. PATENT DOCUMENTS

2006/0218964 A1 10/2006 Saito et al.
2007/0169512 A1* 7/2007 Ishizaka ..... F25B 5/04 62/515
2009/0013704 A1* 1/2009 Oshitani ..... F25B 41/00 62/191

FOREIGN PATENT DOCUMENTS

CN 1840988 A 10/2006
JP 2008082693 A 4/2008
(Continued)

*Primary Examiner* — Melvin Jones
(74) *Attorney, Agent, or Firm* — Harness, Dickey & Pierce, P.L.C.

(57) ABSTRACT

In an ejector refrigeration cycle, an inlet of a nozzle portion of an ejector is connected to a refrigerant outlet side of a high-stage side evaporator, a refrigerant suction port of the ejector is connected to a refrigerant outlet side of a low-stage side evaporator, and an internal heat exchanger is provided for exchanging heat between a high-pressure refrigerant flowing into a low-stage side throttle device for decompressing the refrigerant flowing into the low-stage side evaporator, and a low-stage side low-pressure refrigerant flowing out of the low-stage side evaporator. Because a difference in enthalpy between the inlet and outlet of the low-stage side evaporator can be enlarged, the cooling capacities exhibited by the respective evaporators can be adjusted to be closer to each other even if the flow-rate ratio Ge/Gn of the suction refrigerant flow rate Ge to the injection refrigerant flow rate Gn is set to a relatively small value so as to make it possible to improve the COP of the cycle.

2 Claims, 5 Drawing Sheets

(51) Int. Cl.
*F25B 5/02* (2006.01)
*F25B 41/06* (2006.01)

(58) Field of Classification Search
CPC .. F25B 5/02; F25B 41/067; F25B 2341/0011; B60H 1/32; B60H 1/00; B60H 1/323
USPC ..... 62/500, 498
See application file for complete search history.

(56) References Cited

FOREIGN PATENT DOCUMENTS

| | | | |
|---|---|---|---|
| JP | 2012149790 | A | 8/2012 |
| JP | 2013200057 | A | 10/2013 |
| JP | 2015001365 | A | 1/2015 |
| WO | WO-2013140918 | A1 | 9/2013 |

* cited by examiner

EJECTOR REFRIGERATION CYCLE

CROSS REFERENCE TO RELATED APPLICATIONS

This application is a U.S. National Phase Application under 35 U.S.C. 371 of International Application No. PCT/JP2015/002488 filed on May 18, 2015 and published in Japanese as WO 2015/182057 A1 on Dec. 3, 2015. This application is based on and claims the benefit of priority from Japanese Patent Application No. 2014-112156 filed on May 30, 2014. The entire disclosures of all of the above applications are incorporated herein by reference.

FIELD OF THE INVENTION

The present disclosure relates to an ejector refrigeration cycle that includes a plurality of evaporators for evaporating a refrigerant in different temperature ranges.

BACKGROUND ART

Conventionally, an ejector refrigeration cycle is known to be a vapor compression refrigeration cycle device including an ejector.

In this kind of ejector refrigeration cycle, a refrigerant flowing out of an evaporator is drawn into a refrigerant suction port of an ejector by a suction effect of a high-speed injection refrigerant injected from a nozzle of the ejector. A mixed refrigerant of the injection refrigerant and the suction refrigerant is pressurized by a diffuser (pressurizing portion) of the ejector. Then, the mixed refrigerant pressurized by the diffuser is drawn into a compressor.

Thus, the ejector refrigeration cycle can reduce the power consumption in the compressor, thereby improving a coefficient of performance (COP) of the cycle, compared to a standard refrigeration cycle device in which a refrigerant evaporation pressure in an evaporator is substantially equal to a suction refrigerant pressure in a compressor.

Patent Document 1 discloses the structure of this kind of ejector refrigeration cycle that includes two evaporators. The ejector refrigeration cycle allows a refrigerant to flow out of one evaporator (first evaporator) into a nozzle portion of the ejector, while drawing a refrigerant flowing out of the other evaporator (second evaporator) into a refrigerant suction port of the ejector.

In the ejector refrigeration cycle described in Patent Document 1, the first evaporator and the second evaporator have different ranges of refrigerant evaporation temperature. In the technique of Patent Document 1, the ejector refrigeration cycle is applied to a cold-storage device. The first and second evaporators are arranged in different cold-storage chambers (spaces to be cooled) and designed to be capable of keeping the respective cold-storage chambers cool in different temperature ranges.

RELATED ART DOCUMENT

Patent Document

[Patent Document 1] Japanese Unexamined Patent Application Publication No. 2012-149790

SUMMARY OF INVENTION

Like the cold-storage device described in Patent Document 1, the respective evaporators are configured to cool different spaces to be cooled, and thus are required to exhibit different cooling capacities, depending on the volumes of the respective spaces to be cooled. Here, the term "cooling capacity" as used herein can be defined by multiplying the flow rate of refrigerant circulating through the evaporator (mass flow rate) by a difference in enthalpy that is obtained by subtracting an enthalpy of the refrigerant on an inlet side of the evaporator from an enthalpy of the refrigerant on an outlet side of the evaporator.

In general ejectors, the refrigerant is drawn by the suction effect of the injection refrigerant, thereby recovering the loss of velocity energy caused when decompressing the refrigerant at a nozzle. Then, the diffuser converts the velocity energy of the mixed refrigerant composed of the injection refrigerant and suction refrigerant into pressure energy, thereby pressurizing the mixed refrigerant.

Thus, also in the ejector refrigeration cycle described in Patent Document 1, a pressurizing amount $\Delta P$ in the diffuser can be increased by increasing the flow velocity of the injection refrigerant (mixed refrigerant) with a decreasing flow-rate ratio Ge/Gn of a suction-refrigerant flow rate Ge to an injection-refrigerant flow rate Gn. That is, the mixed refrigerant is pressurized by the diffuser with a decreasing flow-rate ratio Ge/Gn, which makes it easier to exhibit the effect of improving the COP.

When the flow-rate ratio Ge/Gn is set smaller, the flow rate of the refrigerant circulating through the second evaporator is decreased, whereby the cooling capacity exhibited by the second evaporator becomes lower than that exhibited by the first evaporator. Conversely, when the flow-rate ratio Ge/Gn is set larger, the cooling capacity exhibited by the second evaporator can be made closer to that exhibited by the first evaporator, but the pressurizing amount $\Delta P$ is decreased, making it difficult to exhibit the effect of improving the COP.

That is, in the ejector refrigeration cycle equipped with the evaporators, such as that described in Patent Document 1, it is difficult to adjust the cooling capacities exhibited by the respective evaporators to the required levels depending on the application, while achieving the adequate effect of improving the COP by pressurizing the mixed refrigerant by the diffuser.

In particular, when decreasing the flow-rate ratio Ge/Gn to increase the pressurizing amount $\Delta P$, it is difficult to adjust all the cooling capacities exhibited by the respective evaporators to the same level, while achieving the adequate effect of improving the COP.

The present disclosure has been made in view of the foregoing points, and it is a first object of the present disclosure to provide an ejector refrigeration cycle including a plurality of evaporators for evaporating the refrigerant in different temperature ranges and capable of adjusting the cooling capacities exhibited by the respective evaporators.

Further, it is a second object of the present disclosure to provide an ejector refrigeration cycle including a plurality of evaporators for evaporating the refrigerant in different temperature ranges and capable of bringing the cooling capacities exhibited by the respective evaporators close to each other.

An ejector refrigeration cycle according to an aspect of the present disclosure includes: a compressor that compresses and discharges a refrigerant; a radiator that dissipates heat from the refrigerant discharged from the compressor; a first decompression device and a second decompression device that decompress the refrigerant flowing out of the radiator; a first evaporator that evaporates the refrigerant decompressed by the first decompression device;

a second evaporator that evaporates the refrigerant decompressed by the second decompression device; and an ejector that draws the refrigerant on a downstream side of the second evaporator from a refrigerant suction port by a suction effect of an injection refrigerant injected from a nozzle portion adapted to decompress the refrigerant flowing out of the first evaporator, and mixes the injection refrigerant with a suction refrigerant drawn from the refrigerant suction port, to pressurize the mixed refrigerant. Furthermore, the ejector refrigeration cycle includes an internal heat exchanger that exchanges heat between a high-pressure refrigerant and any one of a high-stage side low-pressure refrigerant and a low-stage side low-pressure refrigerant, (i) when the high-pressure refrigerant is defined as a refrigerant circulating through at least one of a refrigerant flow path leading from a refrigerant outlet side of the radiator to an inlet side of the first decompression device and a refrigerant flow path leading from the refrigerant outlet side of the radiator to an inlet side of the second decompression device, (ii) when the high-stage side low-pressure refrigerant is defined as a refrigerant circulating through a refrigerant flow path leading from a refrigerant outlet side of the first evaporator to an inlet side of the nozzle portion of the ejector, and (iii) when the low-stage side low-pressure refrigerant is defined as a refrigerant circulating through a refrigerant flow path leading from a refrigerant outlet side of the second evaporator to the refrigerant suction port of the ejector.

With this arrangement, the refrigerant flowing out of the first evaporator is allowed to flow into the nozzle portion of the ejector, and the refrigerant flowing out of the second evaporator is allowed to be drawn into the refrigerant suction port of the ejector. Therefore, the refrigerant evaporation temperature in the second evaporator can be set in a lower temperature range than the refrigerant evaporation temperature in the first evaporator.

Further, the ejector refrigeration cycle includes the internal heat exchanger that exchanges heat between the high-pressure refrigerant and any one of the high-stage side low-pressure refrigerant and the low-stage side low-pressure refrigerant.

Thus, a difference in enthalpy determined by subtracting an enthalpy of the refrigerant on the inlet side of each evaporator from the enthalpy of the refrigerant on the outlet side of the evaporator (hereinafter referred to as an outlet-inlet enthalpy difference in each evaporator) can be adjusted, or the enthalpy of the refrigerant flowing into the nozzle portion can be raised, thereby making it possible to adjust the cooling capacity exhibited by each evaporator.

For example, the ejector refrigeration cycle includes the branch portion that branches the flow of the refrigerant flowing out of the radiator. One refrigerant outflow port of the branch portion is connected to the inlet side of the first decompression device, and the other refrigerant outflow port of the branch portion is connected to the inlet side of the second compressor. The internal heat exchanger may exchange heat between the low-stage side low-pressure refrigerant and the high-pressure refrigerant circulating through the refrigerant flow path leading from the other refrigerant outflow port of the branch portion to the inlet side of the second decompression device.

With this arrangement, the internal heat exchanger can cool the high-pressure refrigerant circulating through the refrigerant flow path leading from the other refrigerant outflow port of the branch portion to the inlet side of the second decompression device, thereby enlarging the outlet-inlet enthalpy difference in the second evaporator.

Thus, the cooling capacities exhibited by the first evaporator and the second evaporator can be brought closer to each other even when the above-mentioned flow-rate ratio Ge/Gn of the suction refrigerant flow rate Ge to the injection refrigerant flow rate Gn is set small in order to improve the coefficient of performance of the ejector refrigeration cycle.

Alternatively, the ejector refrigeration cycle may include the branch portion that branches the flow of the refrigerant flowing out of the radiator. One refrigerant outflow port of the branch portion is connected to the inlet side of the first decompression device, and the other refrigerant outflow port of the branch portion is connected to the inlet side of the second decompression device. The internal heat exchanger may exchange heat between the high-stage side low-pressure refrigerant and the high-pressure refrigerant circulating through the refrigerant flow path leading from the other refrigerant outflow port of the branch portion to the inlet side of the second decompression device.

Thus, the cooling capacities exhibited by the first evaporator and the second evaporator can be brought closer to each other. Furthermore, the internal heat exchanger heats the high-stage side low-pressure refrigerant, thus making it possible to raise the enthalpy of the refrigerant flowing into the nozzle portion of the ejector.

Accordingly, the recovered energy amount in the ejector can be increased, which can increase the pressurizing amount $\Delta P$ of the ejector without decreasing the flow-rate ratio Ge/Gn. As a result, the cooling capacities exhibited by the first evaporator and the second evaporator can be brought closer to each other.

Alternatively, the ejector refrigeration cycle may include the branch portion that branches the flow of the refrigerant flowing out of the radiator. One refrigerant outflow port of the branch portion may be connected to the inlet side of the first decompression device, and the other refrigerant outflow port of the branch portion may be connected to the inlet side of the second decompression device. The internal heat exchanger may exchange heat between the high-stage side low-pressure refrigerant and the high-pressure refrigerant circulating through the refrigerant flow path leading from the refrigerant outlet side of the radiator to the inlet side of the branch portion.

Thus, the internal heat exchanger heats the high-stage side low-pressure refrigerant, and thereby the cooling capacities exhibited by the first evaporator and the second evaporator can be brought closer to each other.

DESCRIPTION OF EMBODIMENTS

First Embodiment

A first embodiment will be described below with reference to FIGS. 1 to 4. In this embodiment, an ejector refrigeration cycle 10 according to the present disclosure is applied to a vehicle refrigeration cycle device mounted on a refrigerated vehicle. The vehicle refrigeration cycle device in the refrigerated vehicle has functions of cooling interior ventilation air to be blown into the vehicle interior as well as refrigerator internal ventilation air to be blown into a refrigerator placed in a vehicle container.

Thus, in this embodiment, both the vehicle interior space and the refrigerator internal space serve as the spaces to be cooled by the ejector refrigeration cycle 10. In this embodiment, the volume of the vehicle interior is substantially the same as that of the refrigerator, so that the cooling capacities required for cooling these respective spaces become the same.

Note that the cooling capacity in this embodiment is defined as a value determined by multiplying the flow rate of refrigerant (mass flow rate) circulating through the evaporator by a difference in enthalpy (outlet-inlet enthalpy difference) that is obtained by subtracting the enthalpy of the refrigerant on the inlet side of the evaporator from the enthalpy of the refrigerant on the outlet side of the evaporator included in the ejector refrigeration cycle 10.

Figure 1:
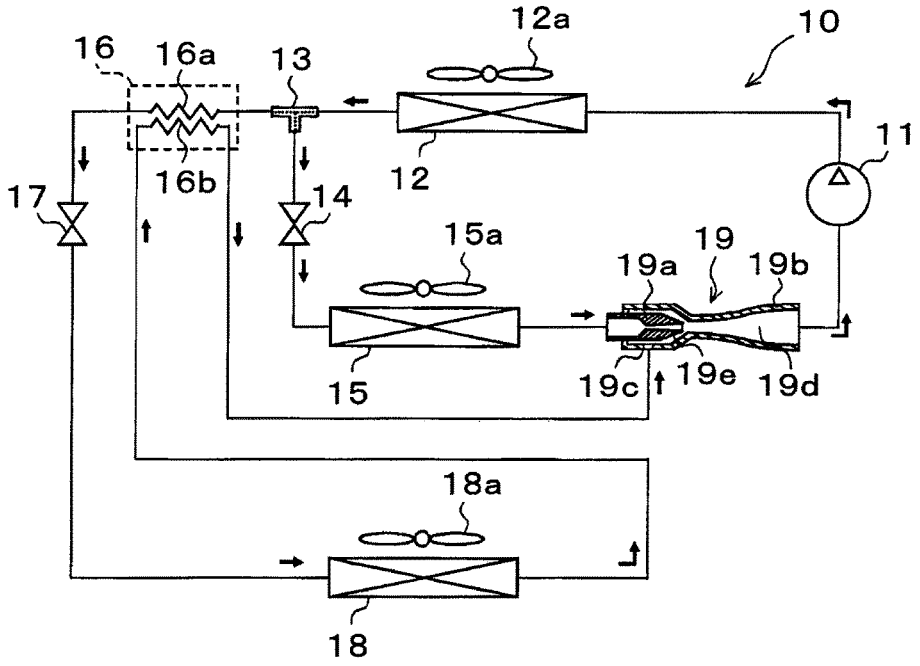
FIG. 1 is an entire configuration diagram of an ejector refrigeration cycle according to a first embodiment.

In the ejector refrigeration cycle 10 shown in the entire configuration diagram of FIG. 1, a compressor 11 draws, compresses, and discharges the refrigerant. Specifically, the compressor 11 of this embodiment is an electric compressor that accommodates a fixed displacement compression mechanism and an electric motor for driving the compression mechanism in one housing.

The compression mechanism suitable for use can include various types of compression mechanisms, such as a scroll compression mechanism, and a vane compression mechanism. The electric motor has its operation (number of revolutions) controlled by a control signal output from a controller to be described later, and may be either an AC motor or a DC motor.

The ejector refrigeration cycle 10 of this embodiment forms a vapor-compression subcritical refrigeration cycle in which a high-pressure side refrigerant pressure does not exceed the critical pressure of the refrigerant, using a natural refrigerant (e.g., R600a) as a refrigerant. Further, refrigerating machine oil for lubricating the compressor 11 is mixed into the refrigerant, and part of the refrigerating machine oil circulates through the cycle together with the refrigerant.

A discharge port of the compressor 11 is connected to a refrigerant inlet side of a radiator 12. The radiator 12 is a heat-dissipation heat exchanger that exchanges heat between a refrigerant discharged from the compressor 11 and a vehicle exterior air (outside air) blown by a cooling fan 12*a*, thereby dissipating heat from the high-pressure refrigerant to cool the refrigerant. The cooling fan 12*a* is an electric blower that has the number of revolutions (ventilation air volume) controlled by a control voltage output from the controller.

A refrigerant outlet side of the radiator 12 is connected to a refrigerant inflow port of a branch portion 13 that branches the flow of refrigerant flowing out of the radiator 12. The branch portion 13 is configured of a three-way joint with three inflow/outflow ports, one of which serves as a refrigerant inflow port, and two of which serve as refrigerant outflow ports. Such a three-way joint may be formed by jointing pipes with different diameters, or by providing a plurality of refrigerant passages in a metal or resin block.

One of the refrigerant outflow ports of the branch portion 13 is connected to the inlet side of a high-stage side throttle device 14 as a first decompression device. The high-stage side throttle device 14 is a thermal expansion valve that has a temperature sensing portion for detecting the superheat degree of the refrigerant on the outlet side of a high-stage side evaporator 15 based on the temperature and pressure of the refrigerant on the outlet side of the high-stage side evaporator 15. The thermal expansion valve is adapted to adjust a throttle passage area by a mechanical mechanism such that the superheat degree of the refrigerant on the outlet side of the high-stage side evaporator 15 is a predetermined reference range.

The outlet side of the high-stage side throttle device 14 is connected to the refrigerant inlet side of the high-stage side evaporator 15 as the first evaporator. The high-stage side evaporator 15 is a heat-absorption heat exchanger that exchanges heat between the low-pressure refrigerant decompressed by the high-stage side throttle device 14 and the interior ventilation air to be blown to the vehicle interior from the high-stage side blower fan 15*a*, thereby evaporating the low-pressure refrigerant to exhibit the heat absorption effect.

The high-stage side blower fan 15*a* is an electric blower that has the number of revolutions (ventilation air volume) controlled by a control voltage output from the controller. The refrigerant outlet side of the high-stage side evaporator 15 is connected to the inlet side of a nozzle portion 19*a* of an ejector 19 to be described later.

The other refrigerant outflow port of the branch portion 13 is connected to the inlet side of a high-pressure side refrigerant passage 16*a* of an internal heat exchanger 16. The internal heat exchanger 16 of this embodiment serves as the function of changing heat between the high-pressure refrigerant flowing out of the other refrigerant outflow port of the branch portion 13 and the low-stage side low-pressure refrigerant flowing out of a low-stage side evaporator 18 to be described later.

Such an internal heat exchanger 16 can adopt a double-pipe heat exchanger that includes an outer pipe and an inner pipe disposed in the outer pipe. The outer pipe forms the high-pressure side refrigerant passage 16*a* for circulation of the refrigerant flowing out of the other refrigerant outflow port of the branch portion 13. The inner pipe forms a low-pressure side refrigerant passage 16*b* for circulation of the low-stage side low-pressure refrigerant flowing out of the low-stage side evaporator 18.

The outlet side of the high-pressure side refrigerant passage 16*a* of the internal heat exchanger 16 is connected to the inlet side of a low-stage side throttle device 17 as a second decompression device. The low-stage side throttle device 17 is a fixed throttle in which a throttle opening degree is fixed. Specifically, a nozzle, orifice, a capillary tube, etc. can be adopted as the low-state side throttle device.

The outlet side of the low-stage side throttle device 17 is connected to the refrigerant inlet side of the low-stage side evaporator 18 as the second evaporator. The low-stage side evaporator 18 is a heat-absorption heat exchanger that exchanges heat between the low-pressure refrigerant decompressed by the low-stage side throttle device 17 and the refrigerator internal ventilation air circulated and blown by the low-stage side blower fan 18*a* into the refrigerator, thereby evaporating the low-pressure refrigerant to exhibit the heat absorption effect.

The low-stage side evaporator 18 has substantially the same fundamental structure as the high-stage side evaporator 15, and the low-stage side blower fan 18*a* has substantially the same fundamental structure as the high-stage side blower fan 15*a*. The refrigerant outlet side of the low-stage side evaporator 18 is connected to the inlet side of the low-pressure side refrigerant passage 16*b* of the internal heat exchanger 16. Further, the outlet side of the low-pressure side refrigerant passage 16*b* is connected to a refrigerant suction port 19*c* side of the ejector 19 to be described later.

Here, the throttle opening degree of the low-stage side throttle device 17 in this embodiment is set smaller than that of the high-stage side throttle device 14 in the normal operation of the cycle. Thus, the refrigerant evaporation pressure (refrigerant evaporation temperature) in the low-stage side evaporator 18 is lower than the refrigerant evaporation pressure (refrigerant evaporation temperature) in the high-stage side evaporator 15.

In this embodiment, the throttle opening degrees (flow rate characteristics) of the high-stage side throttle device 14 and the low-stage side throttle device 17 as well as the passage cross-sectional areas of the respective refrigerant passages in the branch portion 13 are determined during the normal operation of the cycle such that the flow-rate ratio Ge/Gn of the suction refrigerant flow rate Ge to the injection refrigerant flow rate Gn is within a predetermined reference range of 1 or less.

The injection refrigerant flow rate Gn is the flow rate of refrigerant (mass flow rate) that flows into the nozzle portion 19*a* of the ejector 19 via the high-stage side throttle device 14 and the high-stage side evaporator 18. The suction refrigerant flow rate Ge is a refrigerant flow rate (mass flow rate) drawn from the refrigerant suction port 19*c* of the ejector 19 via the high-pressure side refrigerant passage 16*a* of the internal heat exchanger 16, the low-stage side throttle device 17, and the low-stage side evaporator 18.

That is, the injection refrigerant flow rate Gn is the flow rate of refrigerant circulating through the high-stage side evaporator 15, and the suction refrigerant flow rate Ge is the flow rate of refrigerant circulating through the low-stage side evaporator 18.

The ejector 19 serves as a decompression device that decompresses the refrigerant flowing out of the high-stage side evaporator 15, and also as a refrigerant circulation portion (refrigerant transport portion) that draws (transports) the refrigerant flowing out of the low-stage side evaporator 18 by the suction effect of the high-speed injection refrigerant, thereby circulating the refrigerant through the cycle.

More specifically, the ejector 19 includes the nozzle portion 19*a* and a body portion 19*b*. The nozzle portion 19*a* is formed of metal (e.g., a stainless alloy) having a substantially cylindrical shape that gradually tapered toward the flow direction of the refrigerant. The nozzle portion 19*a* isentropically decompresses and expands the refrigerant in a refrigerant passage (throttle passage) formed therein.

The refrigerant passage formed in the nozzle portion 19*a* has a throat portion (portion with the minimum passage area) having the minimum cross-sectional passage area, and a spreading portion having the refrigerant passage area thereof gradually enlarged from the throat portion toward a refrigerant injection port for injecting the refrigerant. That is, the nozzle portion 19*a* is configured as a de Laval nozzle.

This embodiment employs the nozzle portion 19*a* that is designed to set the flow velocity of the injection refrigerant injected from the refrigerant injection port to a speed of sound or higher in the normal operation of the ejector refrigeration cycle 10. It is apparent that the nozzle portion 19*a* may be formed of a convergent nozzle.

The body portion 19*b* is formed of metal (e.g., aluminum) in a substantially cylindrical shape. The body portion 19*b* serves as a fixing member that supports and fixes the nozzle portion 19*a* therein to form an outer shell of the ejector 19. More specifically, the nozzle portion 19*a* is fixed by being pressed into the body portion 19*b* to be accommodated therein on one end side in the longitudinal direction of the body portion 19*b*. Thus, the refrigerant does not leak from a fixed portion (pressed portion) provided between the nozzle portion 19*a* and the body portion 19*b*.

The refrigerant suction port 19*c* is formed to entirely penetrate a part on the outer peripheral surface of the body portion 19*b* corresponding to the outer peripheral side of the nozzle portion 19*a* to thereby communicate with the refrigerant injection port of the nozzle portion 19*a*. The refrigerant suction port 19*c* is a through hole that draws the refrigerant flowing out of the low-stage side evaporator 18 into the ejector 19 by a suction effect of the injection refrigerant injected from the nozzle portion 19*a*.

The inside of the body portion 19*b* is provided with a suction passage 19*e* and a diffuser 19*d*. The suction passage 19*e* guides the suction refrigerant drawn from the refrigerant suction port 19*c* to the refrigerant injection port side of the nozzle portion 19*a*. The diffuser 19*d* serves as a pressurizing portion for mixing the injection refrigerant with the suction refrigerant flowing from the refrigerant suction port 19*c* into the ejector 19 via the suction passage 19*e* to increase the pressure of the mixture.

The suction passage 19*e* is formed in a space between the outer peripheral side of the tip periphery of the convergent nozzle portion 19*a* and the inner peripheral side of the body portion 19*b*. The refrigerant passage area of the suction passage 19*e* is gradually decreased toward the refrigerant flow direction. Thus, the flow velocity of the suction refrigerant circulating through the suction passage 19*e* is gradually increased, which decreases the energy loss (mixing loss) when mixing the suction refrigerant with the injection refrigerant by the diffuser 19*d*.

The diffuser 19*d* is disposed to continuously lead to an outlet of the suction passage 19*e* and formed in such a manner as to gradually increase its refrigerant passage area. Thus, the diffuser has a function of mixing the injection refrigerant and the suction refrigerant to decelerate the flow velocity of the mixed refrigerant, thereby increasing the pressure of the mixed refrigerant of the injection refrigerant and the suction refrigerant, that is, a function of converting the velocity energy of the mixed refrigerant into the pressure energy thereof.

More specifically, the cross-sectional shape of the inner peripheral wall surface of the body portion 19*b* forming the diffuser 19*d* in this embodiment is formed by combination of a plurality of curved lines. The expanding degree of the refrigerant passage cross-sectional area of the diffuser 19*d* is gradually increased and then decreased again toward the refrigerant flow direction, which can isentropically pressurize the refrigerant. The outlet side of the diffuser 19*d* in the ejector 19 is connected to the suction port of the compressor 11.

Note that among the components of the above-mentioned ejector refrigeration cycle 10, the compressor 11, the radiator 12, and the cooling fan 12*a* are accommodated in one casing, and integrally configured as an exterior unit. The exterior unit is placed on the vehicle front side above the refrigerator.

Next, an electric control unit in this embodiment will be described. A controller (not shown) includes the known microcomputers, including a CPU, a ROM and a RAM, and a peripheral circuit thereof. The controller performs various computations and processing based on control programs stored in the ROM to thereby control the operations of various control target devices connected to its output side (compressor 11, cooling fan 12*a*, high-stage side blower fan 15*a*, low-stage side blower fan 18*a*, and the like).

A group of sensors is connected to the controller and designed to input detection values therefrom to the controller. The group of sensors includes an inside-air temperature sensor, an outside-air temperature sensor, a solar radiation sensor, a first evaporator temperature sensor, a second evaporator temperature sensor, an outlet-side temperature sensor, an outlet-side pressure sensor, and a refrigerator-inside temperature sensor. The inside-air temperature sensor detects a vehicle interior temperature. The outside-air temperature sensor detects an outside air temperature. The solar radiation sensor detects the solar radiation amount applied to the vehicle interior. The first evaporator temperature sensor detects the blown-air temperature from the high-stage side evaporator 15 (high-stage side evaporator temperature). The second evaporator temperature sensor detects the blown-air temperature from the low-stage side evaporator 18 (low-stage side evaporator temperature). The outlet-side temperature sensor detects the temperature of the refrigerant on the outlet side of the radiator 12. The outlet-side pressure sensor detects the pressure of the refrigerant on the outlet side of the radiator 12. The refrigerator-inside temperature sensor detects the temperature of the inside of the refrigerator.

The input side of the controller is connected to an operation panel (not shown) that is disposed near an instrument board at the front of the vehicle compartment. Operation signals from various operation switches provided on the operation panel are input to the controller. Specifically, various types of operation switches provided on the operation panel include an operation switch for requesting the operation or stopping of the vehicle refrigeration cycle device, and a vehicle-interior temperature setting switch for setting the temperature of the vehicle interior.

The controller of this embodiment incorporates therein integrated control units for controlling the operations of various control target devices connected to its output side. In the controller, a structure (hardware and software) adapted to control the operation of each control target device serves as the control unit for controlling each control target device. For example, in this embodiment, the structure for controlling the operation of the compressor 11 configures a discharge-capacity control unit.

Next, the operation of the ejector refrigeration cycle 10 in this embodiment will be described with reference to a Mollier diagram of FIG. 2. First, if the operation switch on the operation panel is turned on (in the ON state), the controller starts to operate the electric motor of the compressor 11, the cooling fan 12*a*, the high-stage side blower fan 15*a*, the low-stage side blower fan 18*a*, and the like. In this way, the compressor 11 draws, compresses, and discharges the refrigerant.

Figure 2:
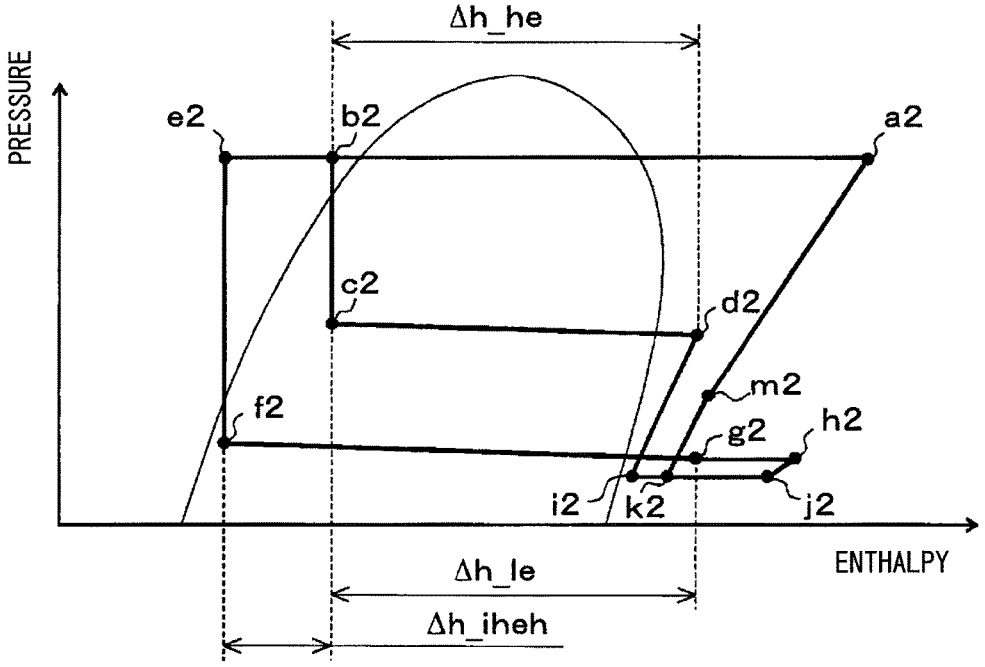
FIG. 2 is a Mollier diagram showing the state of the refrigerant when operating the ejector refrigeration cycle in the first embodiment.

The high-temperature and high-pressure discharge refrigerant discharged from the compressor 11 (at point a2 in FIG. 2) flows into the radiator 12 and exchanges heat with the ventilation air (outside air) blown by the cooling fan 12*a*, thereby dissipating heat therefrom to be condensed (as indicated from point a2 to point b2 in FIG. 2). Further, the flow of the refrigerant from the radiator 12 is branched by the branch portion 13.

One refrigerant branched by the branch portion 13 flows into the high-stage side throttle device 14 and is isentropically decompressed (as indicated from point b2 to point c2 in FIG. 2). At this time, the throttle opening degree of the high-stage side throttle device 14 is adjusted such that a superheat degree of the refrigerant on the outlet side of the high-stage side evaporator 15 (at point d2 in FIG. 2) is within a predetermined range.

The refrigerant decompressed by the high-stage side throttle device 14 flows into the high-stage side evaporator 15 and absorbs heat from the interior ventilation air blown by the high-stage side blower fan 15*a* to evaporate by itself (as indicated from point c2 to point d2 in FIG. 2). In this way, the interior ventilation air is cooled.

The other refrigerant branched by the branch portion 13 flows into the high-pressure side refrigerant passage 16*a* of the internal heat exchanger 16, and exchanges heat with the refrigerant flowing out of the low-stage side evaporator 18 and circulating through the low-pressure side refrigerant passage 16*b* of the internal heat exchanger 16, thereby decreasing its enthalpy (as indicated from point b2 to point e2 in FIG. 2).

The refrigerant flowing out of the high-pressure side refrigerant passage 16*a* of the internal heat exchanger 16 flows into the low-stage side throttle device 17 to be isentropically decompressed (as indicated from point e2 to point f2 in FIG. 2). At this time, the pressure of the refrigerant decompressed by the low-stage side throttle device 17 becomes lower than that decompressed by the high-stage side throttle device 14. In FIG. 2, the pressure at point e2 is lower than that at point c2.

The refrigerant decompressed by the low-stage side throttle device 17 flows into the low-stage side evaporator 18 and absorbs heat from the refrigerator internal ventilation air circulated through and blown by the low-stage side blower fan 18*a* to evaporate by itself (as indicated from point f2 to point g2 in FIG. 2). In this way, the refrigerator internal ventilation air is cooled.

The low-stage side low-pressure refrigerant flowing out of the low-stage side evaporator 18 flows into the low-pressure side refrigerant passage 16*b* of the internal heat exchanger 16, and exchanges heat with the other refrigerant circulating through the high-pressure side refrigerant passage 16*a* of the internal heat exchanger 16 and branched by the branch portion 13, thereby increasing its enthalpy (as indicated from point g2 to point h2 in FIG. 2).

The refrigerant flowing out of the high-stage side evaporator 15 flows into the nozzle portion 19*a* of the ejector 19 to be isentropically decompressed, and is then injected from the ejector (as indicated from point d2 to point i2 in FIG. 2). The refrigerant on the downstream side of the low-stage side evaporator 18 flowing out of the low-pressure side refrigerant passage 16*b* of the internal heat exchanger 16 (at point h2 in FIG. 2) is drawn from the refrigerant suction port 19*c* of the ejector 19 by the suction effect of the injection refrigerant.

At this time, the refrigerant drawn from the refrigerant suction port 19*c* circulates through the suction passage 19*e* formed in the ejector 19 and is isentropically decompressed to slightly decrease its pressure (as indicated from point h2 to point j2 in FIG. 2). The injection refrigerant injected from the nozzle portion 19*a* and the suction refrigerant drawn from the refrigerant suction port 19*c* flow into the diffuser 19*d* of the ejector 19 (as indicated from point i2 to point k2, and from point j2 to point k2, respectively, in FIG. 2).

In the diffuser 19*d*, the velocity energy of the refrigerant is converted into the pressure energy thereof by the enlarged refrigerant passage area. Thus, the mixed refrigerant of the injection refrigerant and the suction refrigerant has its pressure increased (as indicated from point k2 to point m2 in FIG. 2). The refrigerant flowing out of the diffuser 19*d* is drawn into the compressor 11 and compressed again (as indicated from point m2 to point a2 in FIG. 2).

The ejector refrigeration cycle 10 of this embodiment is adapted to operate in the way described above, thereby enabling cooling of the interior ventilation air to be blown into the vehicle interior and the refrigerator internal ventilation air to be circulated and blown to the inside of the refrigerator. At this time, the refrigerant evaporation pressure (refrigerant evaporation temperature) of the low-stage side evaporator 18 is lower than the refrigerant evaporation pressure (refrigerant evaporation temperature) of the high-stage side evaporator 15, so that the vehicle interior and the inside of the refrigerator can be cooled in different temperature ranges.

Further, in the ejector refrigeration cycle 10 of this embodiment, the refrigerant pressurized by the diffuser 19*d* of the ejector 19 (at point m2 in FIG. 2) can be drawn into the compressor 11, thus reducing the power consumption by the compressor 11, thereby improving the coefficient of performance (COP) of the cycle.

Here, like the vehicle refrigeration cycle device of this embodiment, the high-stage side evaporator 15 and the low-stage side evaporator 18 are configured to cool different spaces to be cooled (specifically, the vehicle interior and the inside of the refrigerator). In such a configuration, the cooling capacities exhibited by the respective evaporators 15 and 18 need to be set appropriately depending on the volumes of the respective spaces to be cooled and the like. As mentioned above, in this embodiment, the cooling capacities required for the respective evaporators 15 and 18 are set substantially the same.

In general ejectors, the refrigerant is drawn by the suction effect of the injection refrigerant, thereby recovering the loss of velocity energy caused when decompressing the refrigerant at a nozzle portion. Then, the diffuser converts the velocity energy of the mixed refrigerant composed of the injection refrigerant and suction refrigerant into pressure energy, thereby pressurizing the mixed refrigerant.

Figure 3:
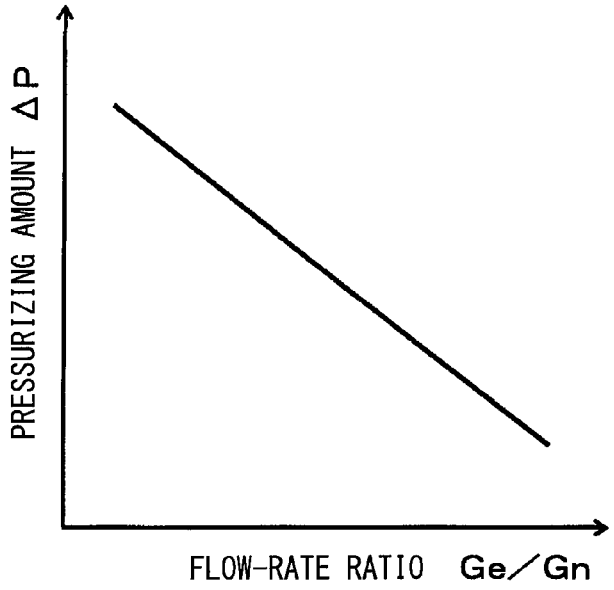
FIG. 3 is a graph showing the relationship between a flow-rate ratio Ge/Gn and a pressurizing amount $\Delta P$ in the ejector of the first embodiment.

Thus, in the ejector refrigeration cycle 10 of this embodiment, as shown in FIG. 3, a pressurizing amount ΔP in the diffuser 19*d* can be increased by increasing the flow velocity of the mixed refrigerant with a decreasing flow-rate ratio Ge/Gn. That is, the mixed refrigerant is pressurized by the diffuser 19*d* with a decreasing flow-rate ratio Ge/Gn, which makes it easier to exhibit the effect of improving the COP.

When the flow-rate ratio Ge/Gn is set smaller, the flow rate of the refrigerant circulating through the low-stage side evaporator 18 is decreased, whereby the cooling capacity exhibited by the low-stage side evaporator 18 is more likely to become lower than that exhibited by the high-stage side evaporator 15.

That is, in the ejector refrigeration cycle equipped with the plurality of evaporators, such as that described in this embodiment, it is difficult to adjust the cooling capacities exhibited by the respective evaporators to the required levels depending on the application, while achieving the adequate effect of improving the COP by pressurizing the mixed refrigerant by the diffuser of the ejector.

In contrast, the ejector refrigeration cycle 10 of this embodiment includes the internal heat exchanger 16 that exchanges heat between a low-stage side low-pressure refrigerant and a high pressure refrigerant. The low-stage side low-pressure refrigerant circulates through a refrigerant flow path leading from the refrigerant outlet of the low-stage side evaporator 18 to the refrigerant suction port 19*c* of the ejector 19. The high pressure refrigerant circulates through a refrigerant flow path leading from the other refrigerant outflow port of the branch portion 13 to the inlet side of the low-stage side throttle device 17.

Therefore, the ejector refrigeration cycle of this embodiment can enlarge the outlet-inlet enthalpy difference in the low-stage side evaporator 18, compared to an ejector refrigeration cycle without having the internal heat exchanger 16 (hereinafter referred to as a comparative cycle").

More specifically, in the comparative cycle, as shown in FIG. 2, an outlet-inlet enthalpy difference in the low-stage side evaporator 18 is Δh_le. In contrast, in the ejector refrigeration cycle 10 of this embodiment, an outlet-inlet enthalpy difference in the low-stage side evaporator 18 is enlarged to Δh_le+Δh_iheh.

With this arrangement, the flow-rate ratio Ge/Gn is set to a smaller value (that is, the suction refrigerant flow rate Ge is set lower than the injection refrigerant flow rate Gn), thereby pressurizing the mixed refrigerant in the diffuser 19*d*, which can sufficiently exhibits the effect of improving the COP. Even in this case, the degradation in cooling capacity exhibited by the low-stage side evaporator 18 can be suppressed.

That is, the ejector refrigeration cycle 10 of this embodiment can bring the cooling capacities exhibited by the high-stage side evaporator 15 and the low-stage side evaporator 18 closer to each other in such a manner as to satisfy formula F1 below.

$$Gn \times \Delta h_he \approx Ge(\Delta h_le + \Delta h_iheh) \quad \text{(F1)}$$

where Δh_he is an outlet-inlet enthalpy difference in the high-stage side evaporator 18.

Further, the ejector refrigeration cycle 10 of this embodiment can obtain the effect of improving the COP by pressurizing the mixed refrigerant by the diffuser 19*d*, and additionally can obtain the effect of improving the COP by enlarging the outlet-inlet enthalpy difference in the low-stage side evaporator 18, compared to the comparative cycle.

Figure 4:
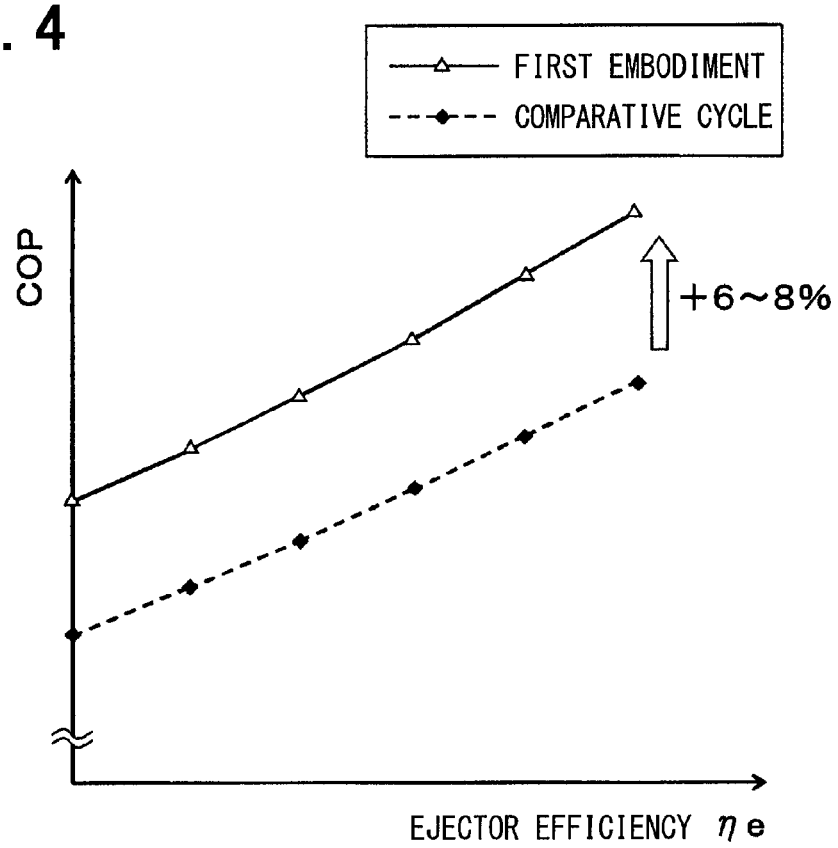
FIG. 4 is a graph showing the relationship between an ejector efficiency $\eta e$ and a coefficient of performance COP in the first embodiment.

Based on studies by the inventors of the present application, as shown in FIG. 4, the ejector refrigeration cycle 10 of this embodiment can improve the COP by about 6 to 8%, compared to the comparative cycle. Note that the horizontal axis of FIG. 4 indicates an ejector efficiency as an energy conversion efficiency of the ejector, which changes depending on conditions for the operation of the ejector refrigeration cycle 10, the specifications, such as size, of the ejector 19, and the like.

As can be seen from FIG. 4, the effect of improving the COP by the ejector refrigeration cycle 10 in this embodiment can be obtained in the wide range of operating conditions for the ejector refrigeration cycle 10, and also can be obtained by employing a variety of ejectors 19 in the wide range of the specifications, such as the size, in the ejector refrigeration cycle 10.

(Second Embodiment)

Figure 5:
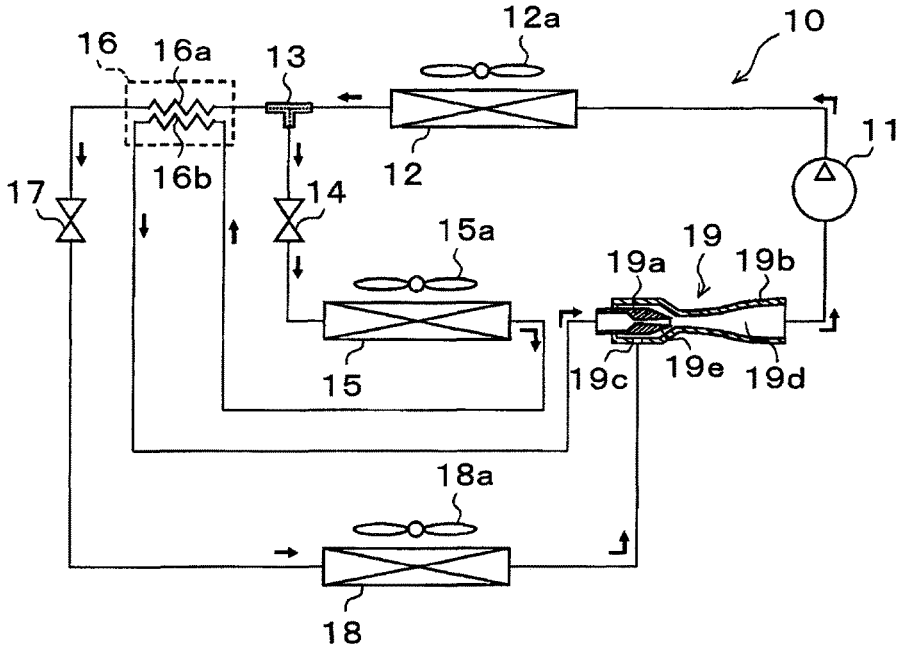
FIG. 5 is an entire configuration diagram of an ejector refrigeration cycle according to a second embodiment.

This embodiment will describe an example in which a connection state of the internal heat exchanger 16 is changed with respect to that in the first embodiment, as shown in FIG. 5. Specifically, in this embodiment, the refrigerant outlet side of the high-stage side evaporator 15 is connected to the inlet side of the low-pressure side refrigerant passage 16*b* in the internal heat exchanger 16. Further, the outlet side of the low-pressure side refrigerant passage 16*b* is connected to an inlet side of the nozzle portion 19*a* in the ejector 19.

Thus, the internal heat exchanger 16 of this embodiment serves the function of exchanging heat between a high-stage side low-pressure refrigerant and a high pressure refrigerant. The high-stage low-pressure refrigerant circulates through a refrigerant flow path leading from the refrigerant outlet side of the high-stage side evaporator 15 to the inlet side of the nozzle portion 19*a* in the ejector 19. The high-pressure refrigerant circulates through a refrigerant flow path leading from the other refrigerant outflow port of the branch portion 13 to the inlet side of the low-stage side throttle device 17.

In this embodiment, the refrigerant outlet of the low-stage side evaporator 18 and the refrigerant suction port 19*c* of the ejector 19 are directly connected together via a refrigerant pipe. Other structures are the same as those of the first embodiment.

Next, the operation of the ejector refrigeration cycle 10 in this embodiment will be described with reference to a Mollier diagram of FIG. 6. Note that regarding reference characters in the Mollier diagram of FIG. 6, the same alphabets as those used in the Mollier diagram of FIG. 2 described in the first embodiment are employed to indicate the equivalent or compatible refrigerant states in the respective cycle configurations, while subscripts (numeric characters) are changed. The same goes for the following Mollier diagrams.

When the ejector refrigeration cycle 10 of this embodiment is operated, like the first embodiment, the high-temperature and high-pressure discharge refrigerant discharged from the compressor 11 (at point a6 in FIG. 6) is cooled in the radiator 12 (as indicated from point a6 to point b6 in FIG. 6) and then branched by the branch portion 13.

Figure 6:
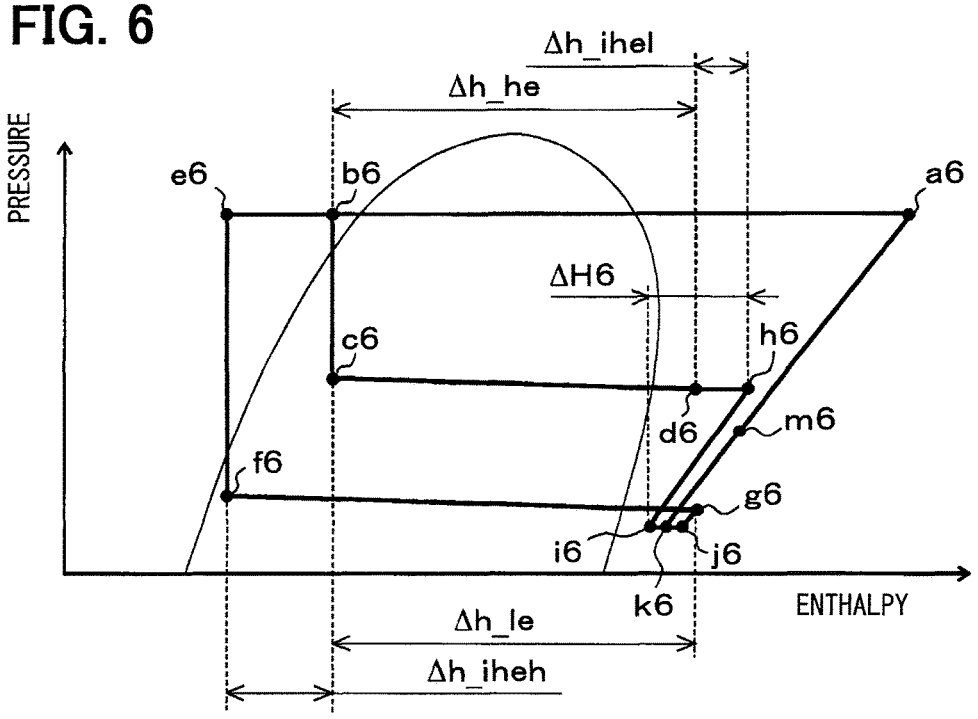
FIG. 6 is a Mollier diagram showing the state of the refrigerant when operating the ejector refrigeration cycle in the second embodiment.

One refrigerant branched by the branch portion 13 is decompressed by the high-stage side throttle device 14, and then flows into the high-stage side evaporator 15 to absorb heat from the interior ventilation air, evaporating by itself (as indicated from point b6 to point c6 and then to point d6 in FIG. 6). In this way, the interior ventilation air is cooled.

Further, in this embodiment, the high-stage side low-pressure refrigerant flowing out of the high-stage side evaporator 15 flows into the low-pressure side refrigerant passage 16*b* of the internal heat exchanger 16, and exchanges heat with the other refrigerant circulating through the high-pressure side refrigerant passage 16*a* of the internal heat exchanger 16 and branched by the branch portion 13, thereby increasing its enthalpy (as indicated from point d6 to point h6 in FIG. 6).

The other refrigerant branched by the branch portion 13 flows into the high-pressure side refrigerant passage 16*a* of the internal heat exchanger 16, and exchanges heat with the refrigerant flowing out of the high-stage side evaporator 15 and circulating through the low-pressure side refrigerant passage 16*b* of the internal heat exchanger 16, thereby decreasing its enthalpy (as indicated from point b6 to point e6 in FIG. 6).

The refrigerant flowing out of the high-pressure side refrigerant passage 16*a* of the internal heat exchanger 16 is decompressed by the low-stage side throttle device 17, and then flows into the low-stage side evaporator 18 to absorb heat from the refrigerator internal ventilation air, evaporating by itself (as indicated from point e6 to point f6 and then to point g6 in FIG. 6). In this way, the refrigerator internal ventilation air is cooled.

In this embodiment, the refrigerant flowing out of the low-pressure side refrigerant passage 16*b* in the internal heat exchanger 16 flows into the nozzle portion 19*a* of the ejector 19 to be isentropically decompressed, and is then injected from the ejector (as indicated from point h6 to point i6 in FIG. 6). The refrigerant on the downstream side of the low-stage side evaporator 18 (at point g6 in FIG. 6) is drawn from the refrigerant suction port 19*c* of the ejector 19 by the suction effect of the injection refrigerant.

The injection refrigerant injected from the nozzle portion 19*a* and the suction refrigerant drawn from the refrigerant suction port 19*c* flow into the diffuser 19*d* of the ejector 19 (as indicated from point i6 to point k6, and from point g6 to point j6 and then to point k6, respectively, in FIG. 6). The diffuser 19*d* converts the velocity energy of the refrigerant to the pressure energy, thereby increasing the pressure of the mixed refrigerant (as indicated from point k6 to point m6 in FIG. 6). The following operations are the same as those in the first embodiment.

Thus, also, the ejector refrigeration cycle 10 of this embodiment can cool the vehicle interior and the inside of the refrigerator in different temperature ranges, like the first embodiment, and can further bring the cooling capacities exhibited by the high-stage side evaporator 15 and the low-stage side evaporator 18 close to each other by the function of the internal heat exchanger 16.

Furthermore, in this embodiment, the enthalpy of the refrigerant flowing into the nozzle portion 19*a* of the ejector 19 can be increased by Δh_ihel shown in FIG. 2 by the function of the internal heat exchanger 16, thereby making it possible to efficiently pressurize the mixed refrigerant in the diffuser 19*d*.

In more detail, the ejector 19 draws the refrigerant by the suction effect of the injection refrigerant as mentioned above, thereby recovering the velocity energy loss caused in decompressing the refrigerant by the nozzle portion 19*a*, thus converting the velocity energy of the mixed refrigerant into the pressure energy at the diffuser 19*d*. Thus, the amount of the recovered velocity energy (recovered energy amount) is increased, thereby enabling the increase in the pressurizing amount ΔP in the diffuser 19*d*.

The energy amount recovered by the nozzle portion 19*a* is represented by a difference in enthalpy (ΔH6 in FIG. 6) between the refrigerant on the inlet side of the nozzle portion 19*a* (at point h6 in FIG. 6) and the refrigerant on the outlet side of the nozzle portion 19*a* (at point i6 in FIG. 6).

Like this embodiment, when the refrigerant is isentropically decompressed by the nozzle portion 19*a* with increasing enthalpy of the refrigerant flowing into the nozzle portion 19*a*, the slope of an isentrope on the Mollier diagram becomes gentle (smaller). Thus, the recovered energy amount can be increased when isentropically expanding the refrigerant by a predetermined pressure through the nozzle portion 19*a*.

Thus, in the ejector refrigeration cycle 10 of this embodiment, the diffuser 19*d* can efficiently pressurize the mixed refrigerant. In other words, in the ejector refrigeration cycle 10 of this embodiment, the pressurizing amount ΔP by the diffuser 19*d* can be increased even without setting the flow-rate ratio Ge/Gn smaller, thereby sufficiently exhibiting the effect of improving the COP due to the pressurization of the mixed refrigerant in the diffuser 19*d*.

That is, the ejector refrigeration cycle 10 of this embodiment can enlarge an adjustable range of the flow-rate ratio Ge/Gn, thereby appropriately controlling the cooling capacities exhibited by the respective evaporators 15 and 18.

(Third Embodiment)

Figure 7:
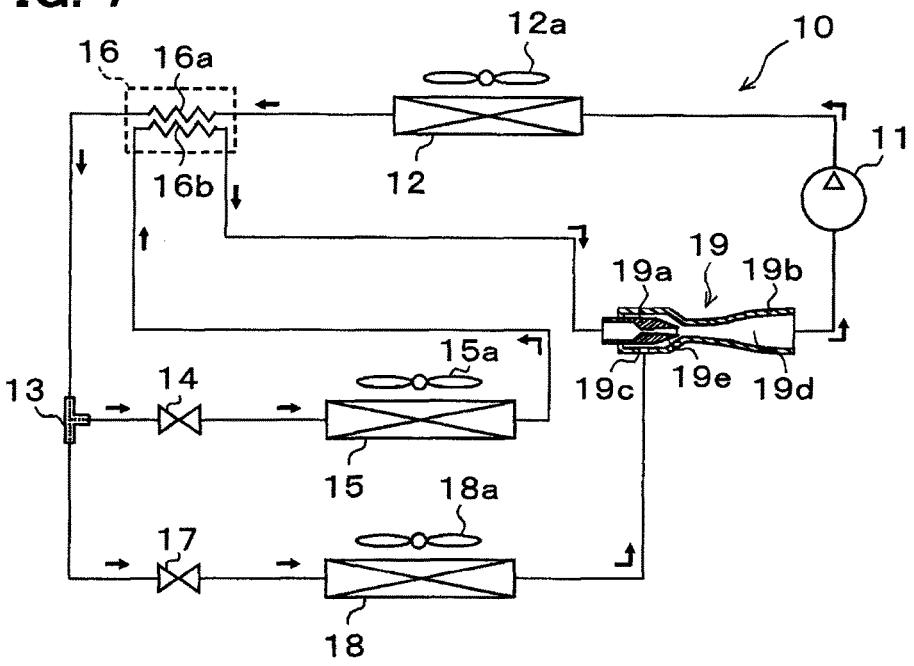
FIG. 7 is an entire configuration diagram of an ejector refrigeration cycle according to a third embodiment.

This embodiment will describe an example in which a connection state of the internal heat exchanger 16 is changed with respect to that in the second embodiment, as shown in FIG. 7. Specifically, in this embodiment, the refrigerant outlet side of the radiator 12 is connected to the inlet side of the high-pressure side refrigerant passage 16*a* in the internal heat exchanger 16. Further, the refrigerant inflow port of the branch portion 13 is connected to the outlet side of the high-pressure side refrigerant passage 16*a* in the internal heat exchanger 16.

Thus, the internal heat exchanger 16 of this embodiment serves the function of exchanging heat between a high-stage side low-pressure refrigerant and a high pressure refrigerant. The high-stage side low-pressure refrigerant circulates through a refrigerant flow path leading from the refrigerant outlet side of the high-stage side evaporator 15 to the inlet side of the nozzle portion 19*a* in the ejector 19. The high-pressure refrigerant circulates through a refrigerant flow path leading from the refrigerant outlet side of the radiator 12 to the inlet side of the branch portion 13.

In this embodiment, the inlet side of the high-stage side throttle device 14 is connected to one refrigerant outflow port of the branch portion 13, while the inlet side of the low-stage side throttle device 17 is connected to the other refrigerant outflow port of the branch portion 13. Other structures and operations are the same as those of the second embodiment.

Next, the operation of the ejector refrigeration cycle 10 in this embodiment will be described with reference to a Mollier diagram of FIG. 8. When the ejector refrigeration cycle 10 of this embodiment is operated, like the first embodiment, the high-temperature and high-pressure refrigerant discharged from the compressor 11 (at point a8 in FIG. 8) is cooled in the radiator 12 (as indicated from point a8 to point b8 in FIG. 8).

Figure 8:
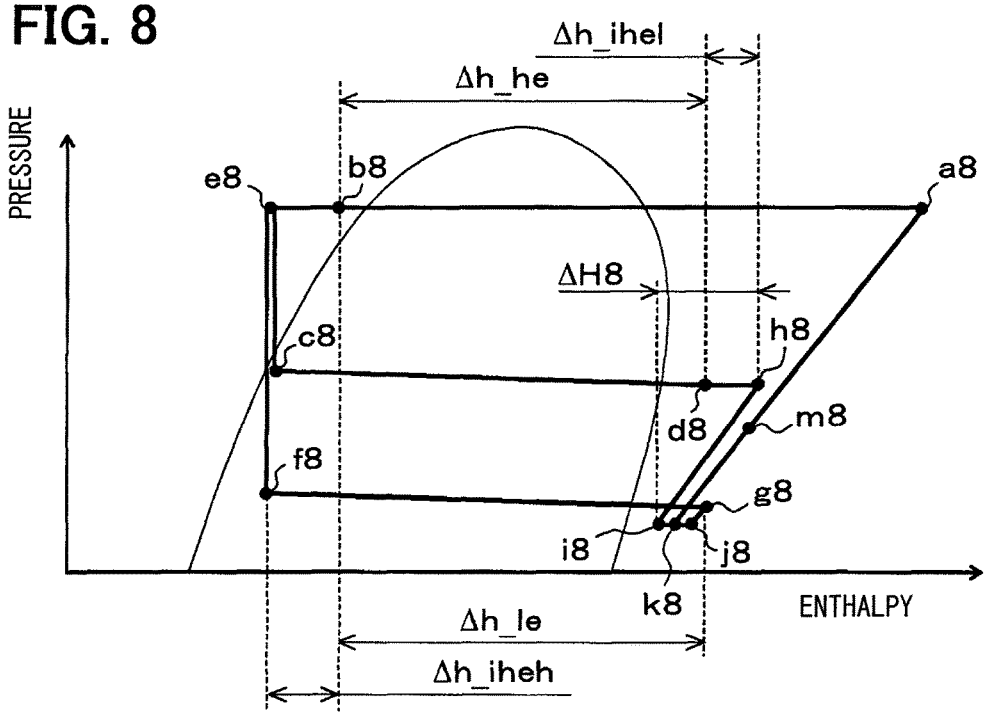
FIG. 8 is a Mollier diagram showing the state of the refrigerant when operating the ejector refrigeration cycle in the third embodiment.

In this embodiment, the high-pressure refrigerant flowing out of the radiator 12 flows into the high-pressure side refrigerant passage 16*a* of the internal heat exchanger 16, and exchanges heat with the refrigerant flowing out of the high-stage side evaporator 15 and circulating through the low-pressure side refrigerant passage 16*b* of the internal heat exchanger 16, thereby decreasing its enthalpy (as indicated from point b8 to point e8 in FIG. 8). The flow of the refrigerant from the high-pressure side refrigerant passage 16*a* is branched by the branch portion 13.

Like the first embodiment, one refrigerant branched by the branch portion 13 is decompressed by the high-stage side throttle device 14, and then flows into the high-stage side evaporator 15 to absorb heat from the interior ventilation air, evaporating by itself (as indicated from point e8 to point c8 and then point d8 in FIG. 8). In this way, the interior ventilation air is cooled.

Further, in this embodiment, the high-stage side low-pressure refrigerant flowing out of the high-stage side evaporator 15 flows into the low-pressure side refrigerant passage 16*b* of the internal heat exchanger 16, and exchanges heat with the other refrigerant circulating through the high-pressure side refrigerant passage 16*a* in the internal heat exchanger 16 and branched by the branch portion 13, thereby increasing its enthalpy (as indicated from point d8 to point h8 in FIG. 8).

The other refrigerant branched by the branch portion 13 is decompressed by the low-stage side throttle device 17, and then flows into the low-stage side evaporator 18 to absorb heat from the refrigerator internal ventilation air, evaporating by itself (as indicated from point e8 to point f8 and then point g8 in FIG. 8). In this way, the refrigerator internal ventilation air is cooled.

In this embodiment, like the second embodiment, the refrigerant flowing out of the low-pressure side refrigerant passage 16*b* in the internal heat exchanger 16 flows into the nozzle portion 19*a* of the ejector 19 to be isentropically decompressed, and is then injected from the ejector (as indicated from point h8 to point i8 in FIG. 8). The refrigerant on the downstream side of the low-stage side evaporator 18 (at point g8 in FIG. 8) is drawn from the refrigerant suction port 19*c* of the ejector 19 by the suction effect of the injection refrigerant. The following operations are the same as that in the second embodiment.

Thus, like the first embodiment, also the ejector refrigeration cycle 10 in this embodiment can cool the vehicle interior and the inside of the refrigerator in different temperature ranges. Further, like the second embodiment, the recovered energy amount in the nozzle portion 19*a* (corresponding to ΔH8 in FIG. 8) can be increased, thereby effectively pressurizing the mixed refrigerant in the diffuser 19*d*, whereby the cooling capacities exhibited by the respective evaporators 15 and 18 can be adjusted appropriately.

(Other Embodiments)

The present disclosure is not limited to the above-mentioned embodiments, and various modifications and changes can be made to these embodiments as follows, without departing from the scope and spirit of the present disclosure.

(1) In the description of the above-mentioned respective embodiments, the internal heat exchanger 16 is connected in such a manner as to bring the cooling capacities exhibited by the high-stage side evaporator 15 and the low-stage side evaporator 18 close to each other by way of example. However, the connection state of the internal heat exchanger 16 is not limited thereto. That is, as long as the cooling capacities exhibited by the respective evaporators 15 and 18 are adjustable, the internal heat exchanger 16 may exchange heat between a pair of low-pressure and high-pressure refrigerants that is different from that disclosed in each of the above-mentioned embodiments.

Figure 9:
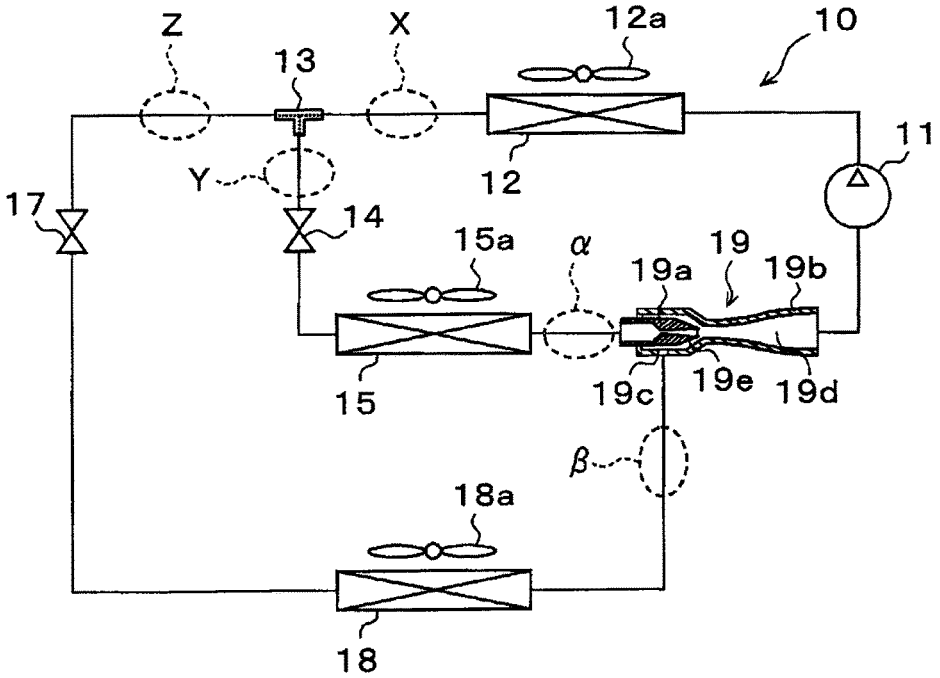
FIG. 9 is an explanatory diagram for explaining a heat exchange form in an internal heat exchanger of another embodiment.

Specifically, as illustrated in FIG. 9, the internal heat exchanger 16 may exchange heat between any one of a high-pressure refrigerant in a region X, a high-pressure refrigerant in a region Y, and a high-pressure refrigerant in a region Z, and one of a low-pressure refrigerant in a region α (high-stage side low-pressure refrigerant) and a low-pressure refrigerant in a region β (low-stage side low-pressure refrigerant). The high-pressure refrigerant in the region X is a high-pressure refrigerant that circulates through a refrigerant flow path leading from the refrigerant outlet side of the radiator 12 to the inlet side of the branch portion 13. The high-pressure refrigerant in the region Y is a high-pressure refrigerant that circulates through a refrigerant flow path leading from the one refrigerant outflow port of the branch portion 13 to the inlet side of the high-stage side throttle device 14. The high-pressure refrigerant in the region Z is a high-pressure refrigerant that circulates through a refrigerant flow path leading from the other refrigerant outflow port of the branch portion 13 to the inlet side of the low-stage side throttle device 17.

For example, the high-pressure refrigerant in the region Y exchanges heat with any one of the low-pressure refrigerants in the regions α and β, whereby the cooling capacity exhibited by the high-stage side evaporator 15 can be adjusted to be larger than that exhibited by the low-stage side evaporator 18. The high-pressure refrigerant in the region X may exchange heat with the low-pressure refrigerant in the region β.

(2) Each of the above-mentioned embodiments has described above the ejector refrigeration cycle 10 in which the one refrigerant outflow port of the branch portion 13 is connected to the inlet side of the high-stage side throttle device 14, while the other refrigerant outflow port of the branch portion 13 is connected to the inlet side of the low-pressure side throttle device 17 by way of example. However, the cycle structure of the ejector refrigeration cycle in the present disclosure is not limited thereto.

Figure 10:
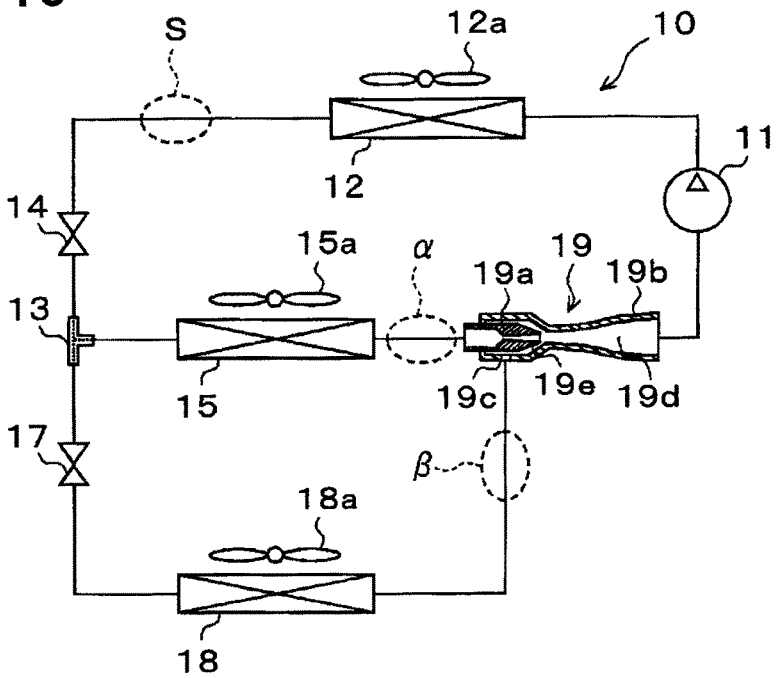
FIG. 10 is an explanatory diagram for explaining a heat exchange form in an internal heat exchanger in an ejector refrigeration cycle of a further embodiment.

For example, a cycle structure shown in FIG. 10 may be formed in which the inlet side of the high-stage side throttle device 14 is connected to the refrigerant outlet side of the radiator 12, the inlet side of the branch portion 13 is connected to the outlet side of the high-stage side throttle device 14, the refrigerant inlet side of the high-stage side evaporator 15 is connected to the one refrigerant outflow port of the branch portion 13, and further the refrigerant inlet side of the low-stage side evaporator 18 is connected to the other refrigerant outflow port of the branch portion 13 via the low-stage side throttle device 17.

In such a cycle structure, the internal heat exchanger 16 may exchange heat between the high-pressure refrigerant in a region S shown in FIG. 10 (high-pressure refrigerant circulating through a refrigerant flow path leading from the refrigerant outlet side of the radiator 12 to the inlet side of the high-stage side throttle device 14), and any one of the low-pressure refrigerants in the regions α and β.

Although in the above-mentioned respective embodiments, the ejector refrigeration cycle 10 includes the two evaporators 15 and 18 for evaporating the refrigerant in different temperature ranges, other evaporator(s) may be provided. The other evaporator(s) may be connected in parallel with the high-stage side or low-stage side evaporator 15 or 18, or in series with the high-stage side or low-stage side evaporator 15 or 18.

(3) Although in the above-mentioned respective embodiments, the ejector refrigeration cycle 10 according to the present disclosure is applied to a refrigeration cycle device for a refrigerated vehicle by way of example, the applications of the ejector refrigeration cycle 10 in the present disclosure are not limited thereto.

For example, the ejector refrigeration cycle 10 according to the present disclosure may be applied to the so-called dual air conditioning system that is designed to cool a front-seat ventilation air to be blown toward the front seat of the vehicle by means of the high-stage side evaporator 15 and to cool a rear-seat ventilation air to be blown toward the rear seat of the vehicle by means of the low-stage side evaporator 18.

The ejector refrigeration cycle in the present disclosure is not limited to the application for vehicles, but may be applied to a stationary refrigerating-freezing device, a show case, an air conditioner, etc. At this time, among a plurality of spaces to be cooled, a low-temperature side space to be cooled to the lowest temperature may cooled by the low-stage side evaporator 18, and a space to be cooled in a higher temperature range than the low-temperature side space may be cooled by the high-stage side evaporator 15.

(4) The components forming the ejector refrigeration cycle 10 are not limited to those disclosed in the above-mentioned embodiments.

For example, the compressor 11 may adopt an engine-driven compressor that is driven by a rotational driving force transferred from the engine (internal combustion engine) via a pulley, a belt, etc. This type of engine-driven compressor suitable for use can be a variable displacement compressor that can adjust the refrigerant discharge capacity by changing its discharge displacement, a fixed displacement compressor that adjusts the refrigerant discharge capacity by changing its operating rate through the connection/disconnection of an electromagnetic clutch, or the like.

The radiator 12 may adopt the so-called subcooling condenser that includes a condensing portion for condensing the refrigerant discharged from the compressor 11 by exchanging heat between the discharge refrigerant from the compressor 11 and the outside air; a modulator for separating the refrigerant flowing out of the condensing portion into liquid and gas phase refrigerants; and a supercooling portion for supercooling the liquid-phase refrigerant flowing out of the modulator by exchanging heat between the liquid-phase refrigerant and the outside air.

The high-stage side throttle device 14 and the low-stage side throttle device 17 suitable for use may be an electric variable throttle mechanism that includes a valve body configured to have its variable throttle opening degree and an electric actuator formed by a stepping motor to vary the throttle opening degree of the valve body.

The internal heat exchanger 16 may adopt a structure that is formed by brazing a refrigerant pipe forming the high-pressure side refrigerant passage **16*a* and a refrigerant pipe forming the low-pressure side refrigerant passage 16*b* together, thereby allowing for the heat exchange between the high-pressure refrigerant and the low-pressure refrigerant. Alternatively, the internal heat exchanger 16 may adopt a structure that includes a plurality of tubes each forming the high-pressure refrigerant passage 16*a* with the low-pressure side refrigerant passage 16*b*** placed between the adjacent tubes.

In the above-mentioned embodiments, the ejector 19 employs a fixed ejector in which a throat portion (portion with the minimum passage area) of the nozzle portion **19*a* does not change its passage cross-sectional area by way of example. Alternatively, the ejector 19 may use a variable ejector with a variable nozzle portion that can adjust its passage cross-sectional area of a throat portion. Although in the above-mentioned embodiments, the components of the ejector 19, such as the body 19*b***, are formed of metal by way of example, materials for the components are not limited as long as they can exhibit their functions. That is, these components may be formed of resin.

(5) The above-mentioned embodiments employ, for example, R600a as the refrigerant, but the refrigerant is not limited thereto. For example, R134a, R1234yf, R410A, R404A, R32, R1234yfxf, R407C, etc. can be used. Alternatively, a mixture made by mixing some of these refrigerants may be used.

What is claimed is:

1. An ejector refrigeration cycle comprising:

a compressor that compresses and discharges a refrigerant;

a radiator that dissipates heat from the refrigerant discharged from the compressor;

a branch portion that branches a flow of the refrigerant flowing out of the radiator;

a first decompression device and a second decompression device that decompress the refrigerant flowing out of the radiator, wherein one refrigerant outflow port of the branch portion is connected to an inlet side of the first decompression device, and the other refrigerant outflow port of the branch portion is connected to an inlet side of the second decompression device;

a first evaporator that evaporates the refrigerant decompressed by the first decompression device to cool air;

a second evaporator that evaporates the refrigerant decompressed by the second decompression device to cool air;

an ejector that draws the refrigerant on a downstream side of the second evaporator from a refrigerant suction port by a suction effect of an injection refrigerant injected from a nozzle portion adapted to decompress the refrigerant flowing out of the first evaporator, and mixes the injection refrigerant with a suction refrigerant drawn from the refrigerant suction port, to pressurize the mixed refrigerant; and an internal heat exchanger that exchanges heat between a high-pressure refrigerant and any one of a high-stage side low-pressure refrigerant and a low-stage side low-pressure refrigerant, (i) when the high-pressure refrigerant is defined as a refrigerant circulating through at least one of a refrigerant flow path leading from a refrigerant outlet side of the radiator to the inlet side of the first decompression device and a refrigerant flow path leading from the refrigerant outlet side of the radiator to the inlet side of the second decompression device, (ii) when the high-stage side low-pressure refrigerant is defined as a refrigerant circulating through a refrigerant flow path leading from a refrigerant outlet side of the first evaporator to an inlet side of the nozzle portion of the ejector, and (iii) when the low-stage side low-pressure refrigerant is defined as a refrigerant circulating through a refrigerant flow path leading from a refrigerant outlet side of the second evaporator to the refrigerant suction port of the ejector, wherein the internal heat exchanger exchanges heat between the low-stage side low-pressure refrigerant and a high-pressure refrigerant circulating through a refrigerant flow path leading from the other refrigerant outflow port of the branch portion to the inlet side of the second decompression device.

2. An ejector refrigeration cycle comprising:

a compressor that compresses and discharges a refrigerant;

a radiator that dissipates heat from the refrigerant discharged from the compressor;

a branch portion that branches a flow of the refrigerant flowing out of the radiator;

a first decompression device and a second decompression device that decompress the refrigerant flowing out of the radiator, wherein one refrigerant outflow port of the branch portion is connected to an inlet side of the first decompression device, and the other refrigerant outflow port of the branch portion is connected to an inlet side of the second decompression device;

a first evaporator that evaporates the refrigerant decompressed by the first decompression device;

a second evaporator that evaporates the refrigerant decompressed by the second decompression device;

an ejector that draws the refrigerant on a downstream side of the second evaporator from a refrigerant suction port by a suction effect of an injection refrigerant injected from a nozzle portion adapted to decompress the refrigerant flowing out of the first evaporator, and mixes the injection refrigerant with a suction refrigerant drawn from the refrigerant suction port, to pressurize a mixed refrigerant of the injection refrigerant and the suction refrigerant; and an internal heat exchanger that exchanges heat between a high-pressure refrigerant and any one of a high-stage side low-pressure refrigerant and a low-stage side low-pressure refrigerant, (i) when the high-pressure refrigerant is defined as a refrigerant circulating through at least one of a refrigerant flow path leading from a refrigerant outlet side of the radiator to an inlet side of the first decompression device and a refrigerant flow path leading from the refrigerant outlet side of the radiator to an inlet side of the second decompression device, (ii) when the high-stage side low-pressure refrigerant is defined as a refrigerant circulating through a refrigerant flow path leading from a refrigerant outlet side of the first evaporator to an inlet side of the nozzle portion of the ejector, and (iii) when the low-stage side low-pressure refrigerant is defined as a refrigerant circulating through a refrigerant flow path leading from a refrigerant outlet side of the second evaporator to the refrigerant suction port of the ejector, wherein the internal heat exchanger exchanges heat between the high-stage side low-pressure refrigerant and a high-pressure refrigerant circulating through a refrigerant flow path leading from the other refrigerant outflow port of the branch portion to the inlet side of the second decompression device.

* * * * *